US006116223A

United States Patent [19]

Feucht

[11] Patent Number: 6,116,223

[45] Date of Patent: Sep. 12, 2000

[54] CAM DRIVEN EXHAUST GAS RECIRCULATION VALVE ASSEMBLY

[75] Inventor: Dennis D. Feucht, Morton, Ill.

[73] Assignee: Caterpillar Inc., Peoria, Ill.

[21] Appl. No.: 08/989,612

[22] Filed: Dec. 12, 1997

[51] Int. Cl.[7] ..... F02M 25/07

[52] U.S. Cl. ..... 123/568.11; 123/568.2; 60/605.2

[58] Field of Search ..... 123/568.11, 568.13, 123/568.2, 568.23, 568.12, 568.15, 568.17, 568.18, 568.19, 568.24, 568.21; 60/605.2

[56] References Cited

U.S. PATENT DOCUMENTS

| | | | |
|---|---|---|---|
| 1,384,133 | 7/1921 | Howe | 123/568.11 |
| 1,632,881 | 6/1927 | Burtnett | 123/568.17 |
| 1,952,881 | 3/1934 | Minter | 123/568.14 |
| 3,675,633 | 7/1972 | Nakajima et al. | 123/568.19 |
| 3,678,909 | 7/1972 | Barker et al. | 123/568.29 |
| 3,682,151 | 8/1972 | Tatsutomi | 123/217 |
| 3,703,164 | 11/1972 | Weaving | 123/568.11 |
| 3,713,428 | 1/1973 | Sandhagen | 123/568.29 |
| 3,901,203 | 8/1975 | Pozniak | 123/568.29 |
| 3,982,514 | 9/1976 | Turns et al. | 123/568.11 |
| 4,009,700 | 3/1977 | Engels et al. | 123/568.27 |
| 4,109,625 | 8/1978 | Kawamura et al. | 123/568.13 |
| 4,256,076 | 3/1981 | Bradshaw | 123/568.29 |
| 4,271,810 | 6/1981 | Lancaster | 123/568.13 |
| 4,424,790 | 1/1984 | Curtil | 123/559.1 |
| 4,561,408 | 12/1985 | Jenkins | 1123/568.23 |
| 5,203,310 | 4/1993 | Gatellier | 123/568.13 |
| 5,558,070 | 9/1996 | Bell et al. | 123/568.21 |
| 5,603,292 | 2/1997 | Häkansson | 123/90.16 |
| 5,682,746 | 11/1997 | von Hoerner | 60/605.2 |
| 5,782,226 | 7/1998 | Gartner | 123/568 |
| 5,937,834 | 8/1999 | Oto | 123/568.15 |

FOREIGN PATENT DOCUMENTS

| | | | |
|---|---|---|---|
| 1-177446 | 7/1989 | Japan . | |
| 2 038 936 | 7/1980 | United Kingdom | F02M 31/08 |

OTHER PUBLICATIONS

Patent Abstract of Japan, JP 04058056 of Feb. 25, 1992, Applicant: Hino Motors Ltd.

Patent Abstracts of Japan, JP 02005749 of Jan. 10, 1990, Applicant: Toyota Motor Corp.

*Primary Examiner*—Willis R. Wolfe
*Attorney, Agent, or Firm*—Maginot, Addison & Moore

[57] ABSTRACT

An internal coumbustion engine assembly which includes an exhaust gas recirculation mechanism, an engine air inlet and an engine exhaust outlet. The engine assembly further includes a valve assembly which includes a valve housing having a housing inlet and a housing outlet, the valve assembly is positionable between a first valve position and a second valve position. The engine assembly still further includes a first conduit which connects the engine exhaust outlet in fluid communication with the housing inlet and a second conduit which connects the engine air inlet in fluid communication with the housing outlet. The engine assembly still further includes a camshaft having a cam member secured thereto with the cam member positionable between a first cam member position and a second cam member position. The cam member interacts with the valve assembly so as to cause the valve assembly to be positioned at the first valve position when the cam member is positioned at the first cam member position and the valve assembly to be positioned at the second valve position when the cam member is positioned at the second cam member position. Engine exhaust gases are allowed to advance from the engine exhaust outlet to the engine air inlet when the valve assembly is positioned in the first valve position. Air is prevented from advancing from the engine air inlet to the engine exhaust outlet when the valve assembly is positioned in the second valve position.

16 Claims, 3 Drawing Sheets

CAM DRIVEN EXHAUST GAS RECIRCULATION VALVE ASSEMBLY

TECHNICAL FIELD OF THE INVENTION

The present invention relates generally to an exhaust gas recirculation (EGR) valve assembly for an internal combustion engine, and more specifically to a cam driven exhaust gas recirculation valve assembly.

BACKGROUND OF THE INVENTION

During operation of an internal combustion engine, it is desirable to control the formation and emission of certain gases, such as the oxides of nitrogen ($NO_x$). One method of achieving this result is the use of exhaust gas recirculation (EGR) which is a process whereby exhaust gases are selectively routed from the exhaust manifold or manifolds to the intake manifold of the internal combustion engine. The use of EGR reduces the amount of $NO_x$ produced during operation of the internal combustion engine. In particular, $NO_x$ is produced when nitrogen and oxygen are combined at high temperatures associated with combustion. The presence of chemically inert gases, such as those gases found in the exhaust of the engine, inhibits nitrogen atoms from bonding with oxygen atoms thereby reducing $NO_x$ production.

A drawback with using EGR on a turbocharged diesel engine is that EGR cannot be used under conditions where the average pressure of air in the intake manifold is greater than the average pressure of exhaust gases in the exhaust manifold. Using EGR under these conditions would result in a net flow of air from the intake manifold to the exhaust manifold, rather than a net flow of exhaust gases from the exhaust manifold to the intake manifold.

One solution to this problem is to increase the average pressure of exhaust gases in the exhaust manifold. Increasing the average pressure in the exhaust manifold is easily achieved by reducing the size of the turbocharger housing or by routing the exhaust gases through an orifice prior to entering the turbocharger housing. However, increasing the average pressure in the exhaust manifold has a drawback in that the engine must expend more energy to advance the exhaust gases from each cylinder to the exhaust manifold.

For applications involving earthmoving equipment and large trucks, the turbocharged diesel engine is configured for rapid response, e.g. the engine must respond rapidly to changing load conditions. To achieve rapid response, small volume exhaust manifolds are connected to specific exhaust ports in order to preserve the pressure of each pulse of exhaust gases that is created when an exhaust valve is opened. The pulses of exhaust gases are directed to the turbocharger's turbine disk which accelerates the turbine disk at a higher rate than is possible when using a large volume exhaust manifold. The turbine disk drives a shaft which accelerates the turbocharger's compressor at the same rate as the turbine disk. The higher compressor acceleration rate enables the turbocharger to compress a greater amount of intake air. The greater amount of air introduced into the cylinders allows more fuel to be burned which increases the engine's power output. The increased power output allows the engine to respond more rapidly to changing load conditions. Furthermore, as turbocharger efficiencies improve, the turbocharger compresses more air into the intake manifold, the average pressure of the air in the intake manifold can become greater than the average pressure of exhaust gases in the exhaust manifold thereby preventing the use of EGR systems which have heretofore been designed. However, the instantaneous pressure of each pulse of exhaust gases in the exhaust manifold during certain operating conditions is greater than the instantaneous pressure of the compressed air in the intake manifold.

In order to utilize the pressure pulses of exhaust gases for EGR purposes, an EGR valve may be configured to open when each of the high pressure pulses is present in the exhaust manifold, and to close when the instantaneous pressure in the intake manifold is greater than the instantaneous pressure in the exhaust manifold (i.e. between pulses of exhaust gases). Thus, the EGR valve could advance exhaust gases from the exhaust manifold to the intake manifold when the average pressure of exhaust gases in the exhaust manifold is less than the average pressure of air in the intake manifold without increasing the average pressure of exhaust gases in the exhaust manifold.

What is needed therefore is an apparatus and method for advancing EGR gases which overcome one or more of the above-mentioned drawbacks.

DISCLOSURE OF THE INVENTION

In accordance with a first embodiment of the present invention, there is provided an engine assembly which includes an internal combustion engine having an engine air inlet and an engine exhaust outlet. The engine assembly further includes a valve assembly which includes a valve housing having a housing inlet and a housing outlet, the valve assembly is positionable between a first valve position and a second valve position. The engine assembly still further includes a first conduit which connects the engine exhaust outlet in fluid communication with the housing inlet. The engine assembly yet further includes a second conduit which connects the engine air inlet in fluid communication with the housing outlet. The engine assembly still further includes a camshaft having a cam member secured thereto. The cam member is positionable between a first cam member position and a second cam member position. The cam member causes the valve assembly to be positioned at the first valve position when the cam member is positioned at the first cam member position. The cam member further causes the valve assembly to be positioned at the second valve position when the cam member is positioned at the second cam member position. Engine exhaust gases are allowed to advance from the engine exhaust outlet to the engine air inlet when the valve assembly is positioned in the first valve position. Air is prevented from advancing from the engine air inlet to the engine exhaust outlet when the valve assembly is positioned in the second valve position.

In accordance with a second embodiment of the present invention, there is provided a method of controlling a flow of engine exhaust in an engine assembly. The engine assembly includes an internal combustion engine having an engine air inlet and an engine exhaust outlet. The engine assembly further includes a valve assembly which includes a valve housing having a housing inlet and a housing outlet, the valve assembly is movable between a first valve position and a second valve position. The engine assembly still further includes a first conduit which connects the engine exhaust outlet in fluid communication with the housing inlet. The engine assembly yet further includes a second conduit which connects the engine air inlet in fluid communication with the housing outlet. The valve assembly places the first conduit in fluid communication with the second conduit when the valve assembly is placed in the first valve position. The valve assembly isolates the first conduit from the second conduit when the valve assembly is placed in the second valve position. The method includes the step of operating the engine assembly so as to cause sequential and repetitive time periods of pressure differential between the engine air inlet and the engine exhaust outlet. Each of the periods include a first subperiod in which pressure at the engine air inlet is greater than or equal to pressure at the engine exhaust outlet. Each period further includes a second subperiod in which pressure at the engine exhaust outlet is greater than or equal to pressure at the engine air inlet. The periods recur at a predetermined frequency which is based on speed of the engine assembly. The method further includes the step of operating the valve assembly based on the predetermined frequency.

BEST MODE FOR CARRYING OUT THE INVENTION

Figure 1:
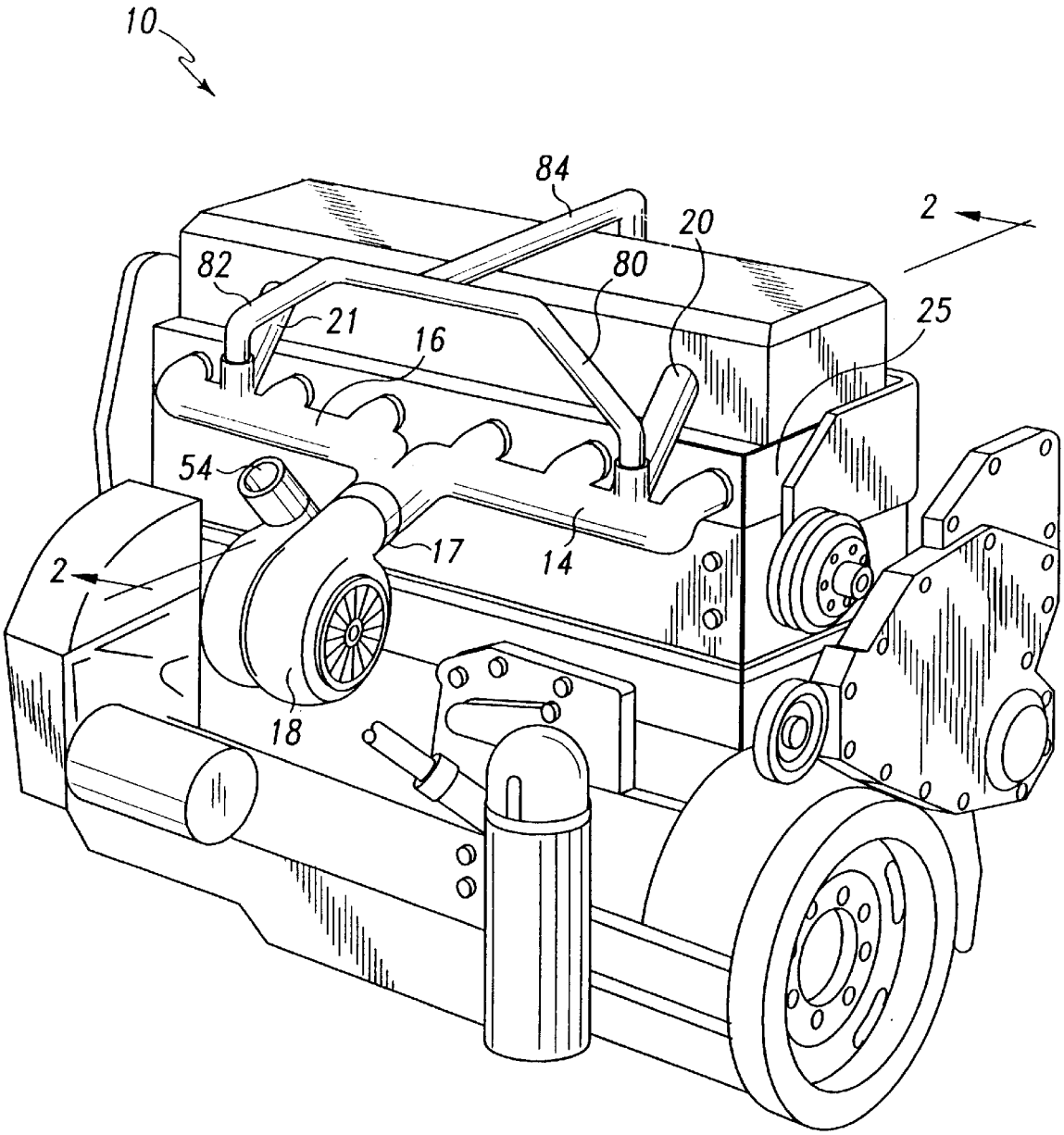
FIG. 1 is a perspective view of an internal combustion engine which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
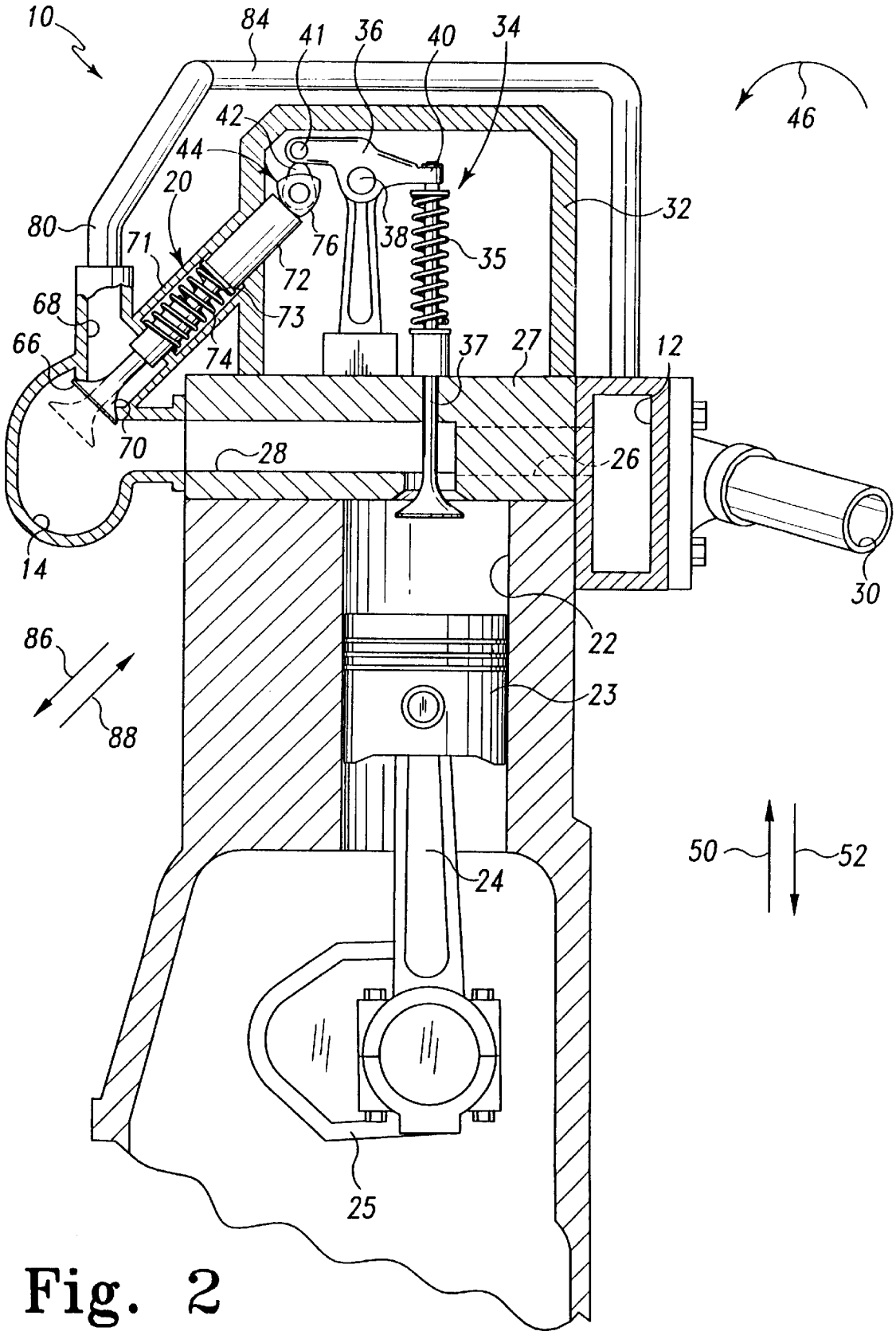
FIG. 2 is a partial cross sectional view of the internal combustion engine taken along line 2—2 of FIG. 1, as viewed in the direction of the arrows.

Referring now to FIGS. 1 and 2, there is shown an internal combustion engine 10 which is a six-cylinder turbocharged diesel engine. The internal combustion engine 10 includes an engine air inlet or intake manifold 12, a first engine exhaust outlet or first exhaust manifold 14, a second engine exhaust outlet or second exhaust manifold 16, a turbocharger 18, a first EGR valve assembly 20, and a second EGR valve assembly 21.

The internal combustion engine 10 is a four stroke engine. The first stroke is an intake stroke wherein air is advanced from the intake manifold 12 to one of the cylinders 22 of the six cylinder internal combustion engine 10. The engine then advances to a compression stroke, where the air is compressed in the cylinder.

Near the end of the compression stroke, a fuel injector (not shown) injects a fuel, such as diesel fuel, into the cylinder 22 thereby creating a fuel and air mixture in the cylinder 22. Near the top of the compression stroke, the fuel and air mixture is ignited in the cylinder 22 by the heat generated as a result of the compression stroke. Ignition of the fuel and air mixture advances the internal combustion engine 10 to a power stroke in which the fuel and air mixture is combusted and exhaust gases are formed. The combustion of the fuel and air mixture produces energy which is converted to mechanical energy in a known manner by a piston 23, a connecting rod 24, and a crankshaft 25. Note that each stroke of the internal combustion engine 10 moves the piston alternately upward or downward causing the crankshaft 25 to rotate one half of a revolution during each stroke. Thus, the completion of the four stroke cycle requires two revolutions of the crankshaft 25.

Thereafter, the internal combustion engine 10 is advanced to an exhaust stroke wherein exhaust gases are advanced from the cylinder 22 to either the first exhaust manifold 14 or the second exhaust manifold 16. It should be appreciated that the front three cylinders 22 of the internal combustion engine 10 are in fluid communication with the first exhaust manifold 14, whereas the rear three cylinders 22 are in fluid communication with the second exhaust manifold 16.

The engine 10 further includes an engine head 27 with a number of air inlet ports 26 and exhaust outlet ports 28 defined therein. Each of the cylinders 22 has one air inlet port 26 and one exhaust outlet 28 as shown in FIG. 2. The intake manifold 12 places the air inlet ports 26 in fluid communication with air inlet 30 associated with the internal combustion engine 10. The first exhaust manifold 14 and the second exhaust manifold 16 place the exhaust outlet ports 28 in fluid communication with an inlet 17 of the turbocharger 18. It should be appreciated that the exhaust manifold 14 is in fluid communication with the exhaust ports 28 of each of the front three cylinders of the internal combustion engine 10, whereas the exhaust manifold 16 is in fluid communication with the exhaust ports 28 of the rear three cylinders of the internal combustion engine 10.

An upper portion of the engine includes a valve cover 32 which is sealably secured to the engine head 27. The valve cover 32 covers an exhaust valve assembly 34. It should be appreciated that the valve cover 32 is sealably secured to the engine head 27 such that an engine lubricant, such as oil, is contained therein so as to lubricate a number of components associated with the internal combustion engine 10.

When the exhaust valve assembly 34 is placed in a closed position, the cylinder 22 is isolated from the exhaust outlet ports 28 and hence the exhaust manifolds 14, 16. During the exhaust stroke, the exhaust valve assembly 34 is placed in an open position, as shown in FIG. 2, which places the cylinder 22 in fluid communication with the exhaust manifolds 14, 16 through the exhaust outlet ports 28. The exhaust valve assembly 34 includes an exhaust valve member 37 and an exhaust spring 35 concentrically mounted about the exhaust valve member 37. The exhaust spring 35 applies a force or bias in the general direction of arrow 50 to the exhaust valve member 37 that biases the exhaust valve assembly 34 into the closed position. Hence, the exhaust valve assembly 34 is held in the closed position until urged by the exhaust rocker arm 36 into the open position during the exhaust stroke.

The exhaust rocker arm 36 is movably secured to the engine head 27. In particular, the exhaust rocker arm 36 is free to pivot about a rocker shaft 38 which is non-movably secured to the engine head 27. A first end 40 of the exhaust rocker arm 36 is operatively coupled to the exhaust valve member 37, whereas a second end 41 of the exhaust rocker arm 36 is operatively coupled to an exhaust cam lobe 42 of the camshaft 44.

As the camshaft 44 is rotated in the general direction of arrow 46, the exhaust cam lobe 42 is moved into and out of contact with the second end 41 of the exhaust rocker arm 36 during rotation of the camshaft 44.

When the cam lobe 42 is rotated into contact with the second end 41 of the rocker arm 36, the second end 41 is urged in the general direction of arrow 50. As the second end 41 of the exhaust rocker arm 36 is urged in the general direction of arrow 50, the exhaust rocker arm 36 pivots about the rocker shaft 38 thereby causing the first end 40 of the exhaust rocker arm 36 to be urged in the general direction of arrow 52 thereby likewise urging the exhaust valve member 37 in the general direction of arrow 52. When the force exerted on the exhaust valve member 37 by the first end 40 of the exhaust rocker arm 36 is greater in magnitude than the spring bias generated by the exhaust spring 35, the exhaust valve member 37 is moved in the general direction of arrow 52 thereby positioning the exhaust valve assembly 34 in the open position. When the camshaft 44 is rotated beyond the maximum height of the cam lobe 42, the spring bias of the exhaust spring 35 urges the exhaust valve member 37 in the general direction of arrow 50 thereby returning the exhaust valve assembly 34 to the closed position. It should be appreciated that as the exhaust valve member 37 is urged in the general direction of arrow 50 by the exhaust spring 35, the first end 40 of the exhaust rocker arm 36 is likewise urged in the general direction of arrow 50 which causes the exhaust rocker arm 36 to pivot about the rocker shaft 36 thereby causing the second end 41 of the exhaust rocker arm 36 to be urged in the general direction of arrow 52.

It should therefore be appreciated that as the exhaust valve assembly 34 is placed in the open position, exhaust gases within the cylinder 22 are allowed to advance from the cylinder 22, through the exhaust outlet ports 28, and into the exhaust manifolds 14, 16. It should further be appreciated that as the exhaust valve assembly 34 is placed in the closed position, the cylinder 22 is isolated from the exhaust manifolds 14, 16 thereby inhibiting advancement of the exhaust gases out of the cylinder 22.

During an exhaust stroke, the pressure generated by the exhaust gases in the cylinder 22 is greater than the pressure in the exhaust manifolds 14, 16 and the exhaust gases advance from the cylinder 22, through the exhaust outlet ports 28, and into the exhaust manifolds 14, 16 so as to create a pressure pulse in the exhaust manifolds 14, 16.

The first exhaust manifold 14 and the second exhaust manifold 16 each have small volumes in order to preserve the pressure of each pulse of exhaust gases that is created when an exhaust valve assembly 34 is opened. The pulses of exhaust gases are directed to the turbine inlet 17 of the turbocharger 18 so as to accelerate a turbine disk (not shown) at a higher rate than is possible when using a large volume exhaust manifold. The turbine disk drives a shaft which accelerates the turbocharger's compressor (not shown) at the same rate as the turbine disk. The higher compressor acceleration rate enables the turbocharger 18 to compress and advance a greater amount of intake air to the compressor outlet 54 of the turbocharger 18. The compressed air from the compressor outlet 54 of the turbocharger 18 is then routed to the engine air inlet 30. It should be appreciated that the compressed air from the turbocharger is commonly routed through a cooler (not shown) prior to reaching the engine air inlet 30 in order to increase the thermal efficiency of the internal combustion engine 10.

As turbocharger efficiencies improve, the average pressure of the air in the intake manifold 12 can become greater than the average pressure of exhaust gases in the exhaust manifold 14, 16 thereby preventing the use of conventional EGR valve assemblies. However, the instantaneous pressure of each pulse of exhaust gases in the exhaust manifolds 14, 16 can be greater than the instantaneous pressure of the compressed air in the intake manifold 12.

During certain operating conditions of the internal combustion engine 10, it is desirable to inhibit the formation of $NO_x$ by introducing chemically inert exhaust gases into the cylinder 22 during the intake stroke. Hence, the EGR valve assemblies 20, 21 routes exhaust gases from the exhaust manifolds 14, 16 to the intake manifold 12. In particular, the first EGR valve assembly 20 places the exhaust manifold 14 in fluid communication with the intake manifold 12 whereas the second EGR valve assembly 21 places the exhaust manifold 16 in fluid communication with the intake manifold 12. It should be noted that the mechanical configuration of the first EGR valve assembly 20 is substantially identical to the mechanical configuration of the second EGR valve assembly 21. As a result, only the first EGR valve assembly 20 is described in detail.

To route exhaust gases from the exhaust manifolds 14, 16 to the intake manifold 12, the engine assembly 10 further includes a first EGR line 80, a second EGR line 82 and a third EGR line 84. The first EGR line 80 places the exhaust manifold 14 in fluid communications with the third EGR line 84 via the first EGR valve assembly 20. The second EGR line 82 places the exhaust manifold 16 in fluid communications with the third EGR line 84 via the second EGR valve assembly 21. The third EGR line 84 places the intake manifold 12 in fluid communication with the first EGR line 80 and the second EGR line 82. Thus, the exhaust manifold 14 is placed in fluid communication with the intake manifold 12 via a fluid path that includes the first EGR valve 20, the first EGR line 80, and the third EGR line 84. Similarly, the exhaust manifold 16 is placed in fluid communication with the intake manifold 12 via a fluid path that includes the second EGR valve 21, the second EGR line 82, and the third EGR line 84.

The first EGR valve assembly 20 includes a valve member 70, a housing 71, a cam follower 72, a spring retainer 73, and an EGR spring 74. An inlet 66 of the valve housing 71 is in fluid communication with the exhaust manifold 14 whereas an outlet 68 of the valve housing 71 is in fluid communication with the first EGR line 80. The valve member 70 is positioned in the housing 71 and is movable between a first valve position in which the valve member 70 is spaced apart from the inlet 66 (as shown in phantom in FIG. 2) and a second valve position shown in solid lines FIG. 2. In the second valve position, the valve member 70 blocks flow between the exhaust manifold 14 and the first EGR line 80 so as to isolate the exhaust manifold 14 from the intake manifold 12. In the first valve position, the valve member 70 enables fluid flow between the exhaust manifold 14 and the first EGR line 80 so as to place the exhaust manifold 14 in fluid communication with the intake manifold 12.

The spring retainer 73 is secured to one end of the valve member 70. The EGR spring 74 is interposed between the spring retainer 73 and the housing 71 thereby urging the valve member 70 in the general direction of arrow 88 so as to bias the valve member 70 toward the second valve position. One end of the cam follower 72 is operatively coupled to the end of the valve member 70 which is attached to the spring retainer 73 whereas the other end of the cam follower 72 is operatively positioned in contact with a three lobed cam member 76. The cam follower 72 is moveable in the general direction of arrows 86 and 88.

The speed of the engine assembly 10 is defined by the rotational speed of the crankshaft 25 in the general direction of arrow 46. The exhaust valve assembly 37 must be positioned in the open position during the exhaust stroke, and positioned in the closed position during the other three strokes. Since each stroke of the four stroke cycle requires one half of a revolution of the crankshaft 25 to complete, the cam lobe 42 must urge exhaust valve assembly 37 into the open position once during the two rotations of the crankshaft 25 required to complete the four stroke cycle. Therefore, the camshaft 44 must rotate at one half of the crankshaft speed, so as to urge the exhaust valve assembly 34 into the open position with the cam lobe 42 during the exhaust stroke.

As the camshaft 44 is rotated one half the engine speed in the general direction of arrow 46, the three lobed cam member 76 of the camshaft 44 is moved between a first cam member position to a second cam member position. In the first cam member position, a lobe of the cam member 76 is urged against the cam follower 72 in the general direction of arrow 86 of FIG. 2 so that the valve member 70 is positioned in the first valve position. It should be appreciated that when the valve member 70 is in the first valve position, exhaust gases are enabled to flow from the exhaust manifold 14 to the intake manifold 12.

As the camshaft 44 rotates, the three lobed cam member 76 is moved into a second cam member position. In the second cam member position, the spring bias of the EGR spring 74 urges the valve member 70 in the general direction of arrow 88 thereby positioning the valve member 70 in the second valve position as shown in FIG. 2. It should be appreciated that when the valve member 70 is in the second valve position, the valve member 70 blocks the flow of exhaust gases between exhaust manifold 14 and the intake manifold 12.

Figure 3:
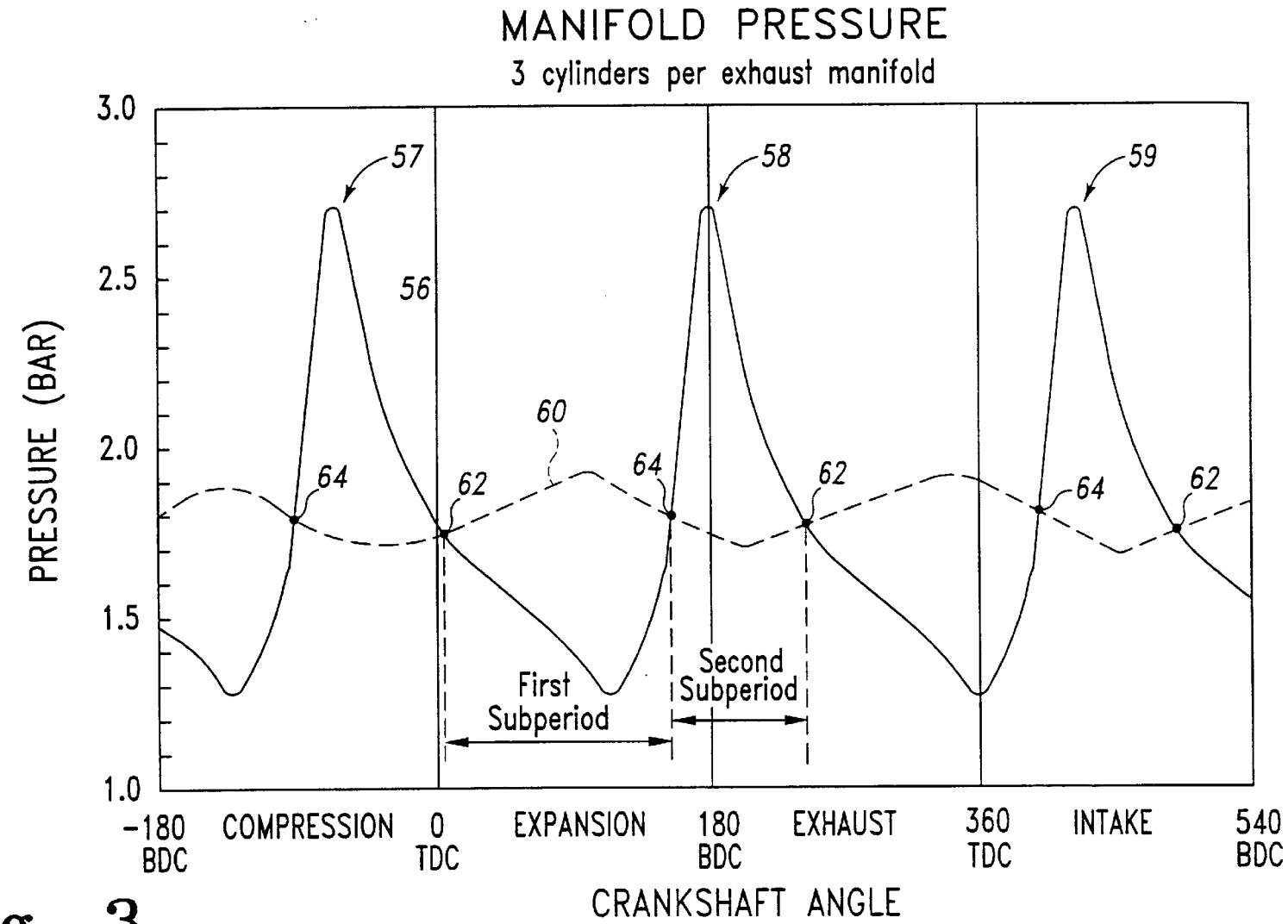
FIG. 3 is a chart showing the manifold pressures of the internal combustion engine of FIG. 1.

Referring now to FIG. 3, there is shown a graph of the pressure in the intake manifold 12 and the exhaust manifold 14 of the turbocharged diesel internal combustion engine 10. The solid line 56 represents an exhaust pressure curve which depicts the pressure of exhaust gases in the exhaust manifold 14. Note that the four stroke cycle described above is completed once every two revolutions of the crankshaft 25, i.e. each of the four strokes corresponds to either a downward motion of piston 23 in the general direction of arrow 52 or an upward motion of the piston 23 in the general direction of arrow 50. The intake and power strokes are performed on the downward motion of the piston 23 whereas the compression and exhaust strokes are performed on an upward motion. Thus, to complete all four strokes, the crankshaft 25 must rotate through the two revolutions or the 720 degrees shown in FIG. 3.

It should be appreciated that during each exhaust stroke, the exhaust valve assembly 34 is opened to advance exhaust gases from the cylinder 22 through the exhaust port 28 and to the exhaust manifold 14 whereby each cylinder 22 which is in fluid communication with the exhaust manifold 14 creates a pulse 57, 58 or 59 of exhaust gases in the exhaust manifold 14. It should further be appreciated that the exhaust manifold 14 is in fluid communication with the exhaust ports 28 of the three front cylinders of the internal combustion engine 10 so as to produce a total of three exhaust pulses 57, 58, and 59 during each period defined by two revolutions of the crankshaft 25 shown in FIG. 3. The frequency that each of the pulses 57, 58 and 59 recur is once per every two revolutions of the crankshaft 25 thereby resulting in a total of three pulses every two revolutions of the crankshaft 25 as shown in FIG. 3.

The dotted line 60 represents an intake pressure curve which depicts the pressure of air in the intake manifold 14. Note that the pressure of air in the intake manifold exhibits less variation than the pressure of exhaust gases in the exhaust manifold 14. The lack of variation is do to a larger volume of air in the intake system as compared to the exhaust manifold 14 and a lack of strong pulse generating disturbances in the intake manifold 12. This larger volume of air includes intake air routed from the compressor outlet 54 to a cooler (not shown) then back to the air intake 30 prior to entering the intake manifold 12. Whereas, the exhaust manifolds 14, 16 have smaller volumes in order to supply a high pressure exhaust gas flow to the turbine inlet 17 of the turbocharger 18.

Therefore, the pressures plotted in FIG. 3 shows three sequential and repetitive time periods. Each time period starts and ends at a point 62. The point 62 of the graph exists at a location on the exhaust pressure curve where the pressure in the exhaust manifold 14 is exhibiting a decreasing trend. Also, the point 62 of the graph exists at a point where the instantaneous pressure of air in the intake manifold 12 is equal to the instantaneous pressure of exhaust gases in the exhaust manifold 14. Each time period also includes a point 64. The point 64 of the graph exits at a location on the exhaust pressure curve where the pressure in the exhaust manifold 14 is exhibiting an increasing trend. Also, the point 64 of the graph exists at a location where the instantaneous pressure of air in the intake manifold 12 is equal to the instantaneous pressure of exhaust gases in the exhaust manifold 14.

Starting at one of the points 62 and advancing to the right to the first subsequent point 64 defines a first subperiod. During the first subperiod, the pressure of air in the intake manifold 12 represented by the dotted line 60 is greater than the pressure of the exhaust gases in the exhaust manifold 14 represented by line 56. Starting one of the points 64 and advancing to the right to the first subsequent point 62 defines a second subperiod. During the second subperiod, the pressure of air in the intake manifold 12 represented by the dotted line 60 is less than the pressure of the exhaust gases in the exhaust manifold 14 represented by line 56.

The three lobed cam member 76 is advantageously configured to advance exhaust gases from the exhaust manifold 14 to the intake manifold 12. In particular, each lobe of the three lobed cam member 76 urges the valve member 70 into the first valve position thereby enabling the flow of exhaust gases from the exhaust manifold 14 to intake manifold 12 during the second subperiod when the pressure of exhaust gases in the exhaust manifold 14 is higher than the pressure of air in the intake manifold 12. Thus, the exhaust gases are advanced from the exhaust manifold 14 to the intake manifold 12 during the second subperiod.

Conversely, the EGR spring 74 urges the valve member 70 into the second valve position thereby blocking the flow of air from the intake manifold 12 to the exhaust manifold 14 during the first subperiod when the pressure of exhaust gases in the exhaust manifold 14 is lower than the pressure of air in the intake manifold 12. Thus, air in the intake manifold 12 is prevented from advancing to the exhaust manifold 14 during the first subperiod.

It should be appreciated that the cam member 76 is configured to correspond to the number of pressure pulses which are generated during each period of two revolutions of the crankshaft 25. In the exemplary embodiment, three cylinders of a six cylinder diesel engine are in fluid communication with the exhaust manifold 14. As each cylinder performs an exhaust stroke, a pressure pulse is advanced from the cylinder 22 to the exhaust manifold 14. Thus, three pressure pulses are advanced for every two revolutions of the crankshaft 25.

Alternately, a four cylinder internal combustion engine with a single exhaust manifold would advance four pulses to the exhaust manifold during each two revolution period of the crankshaft 25 so as to require a four lobed cam member to properly actuate a similar EGR valve assembly.

It should further be appreciated that the exhaust manifold 16 is similar to the exemplary exhaust manifold 14. In particular, each exhaust manifold is in fluid communication with the three cylinders of the internal combustion engine 10. Furthermore, the second EGR valve 21 and the second EGR line 82 which connects the exhaust manifold 16 to the third EGR line 84 is substantially identical to the first EGR valve 20 and the first EGR line 80 which connects the exhaust manifold 14 to the third EGR line 84.

It should still further be appreciated that the frequency at which the valve member 70 is moved from the first valve position to the second valve position depends on the speed of the camshaft 44, and the number of lobes on the cam member 76. The camshaft 44 rotates at one half the engine speed. Thus, increasing the speed of the internal combustion engine 10 increases the frequency at which the valve member 70 is moved from the first valve position to the second valve position. Similarly, decreasing the speed of the internal combustion engine 10 decreases the frequency at which the valve member 70 is moved from the first valve position to the second valve position. Furthermore, the number of times that the valve member 70 is moved from the first valve position to the second valve position during a single revolution of the camshaft 44 is equal to the number of lobes on the cam member 76.

Industrial Applicability

Under certain operating conditions of a turbocharged diesel engine, the average pressure of air in the intake manifold 12 is greater than the average pressure of exhaust gases in an exhaust manifold 14. Therefore, if a conventional EGR valve is opened, a greater amount of air will flow from the intake manifold 12 to the exhaust manifold 14 as compared to the amount of exhaust gases flowing from the exhaust manifold 14 to the intake manifold 12.

However, each of the three cylinders 22 in fluid communication with the exhaust manifold 14 creates a pressure pulse 57, 58, and 59 in the exhaust manifold 14 as the respective exhaust valve assembly 34 is opened during an exhaust stroke. During a period consisting of two crankshaft revolutions, each of the pressure pulses 57, 58 and 59 has a peak pressure greater than the maximum pressure of air in the intake manifold 12. Therefore, each period includes three first subperiods during which the pressure in the intake manifold 12 is greater than the pressure in the exhaust manifold 14. Similarly, each period includes three second subperiods during which the pressure in the intake manifold 12 is less than the pressure in the exhaust manifold 14. In order to advance exhaust gases from the exhaust manifold 14 to the intake manifold 12, an EGR valve assembly 20 must be operable to open during each of the second subperiods.

In order to open the EGR valve assembly 20 during of the second subperiods, the three lobed cam member 76 attached to the camshaft 44 is rotated at one half the engine speed in the general direction of arrow 46. The number of cam lobes on the cam member 76 is equal to the number of cylinders in fluid communication with the exhaust manifold 14. In particular, each lobe of the three lobed cam member 76 urges the valve member 70 into the first valve position during each of the second subperiods where the pressure of exhaust gases in the exhaust manifold 14 is greater than the pressure of air in the intake manifold 12. In the first valve position, exhaust gases in the exhaust manifold 14 are enabled to flow to the intake manifold 12 via a fluid path which includes the first EGR valve 20, the first EGR line 80, and the third EGR line 84. Thus, exhaust gases are advanced from the exhaust manifold 14 to the intake manifold 12 during each of the second subperiods.

Similarly, the EGR spring 74 urges the valve member 70 into the second valve position during each of the first subperiods where the pressure of exhaust gases in the exhaust manifold 14 is less than the pressure of air in the intake manifold 12. In the second valve position, the valve member 70 blocks fluid flow between the exhaust manifold 14 and the intake manifold 12. Thus, air is prevented from advancing from the intake manifold 12 to the exhaust manifold 14 during each of the first subperiods.

Therefore, the EGR valve assembly 20 enables fluid flow between the exhaust manifold 14 and the intake manifold 12 when the pressure of exhaust gases in the exhaust manifold 14 is greater than the pressure of air in the intake manifold 12. In addition, the EGR valve assembly 20 blocks fluid flow between the intake manifold 12 and the exhaust manifold 14 when the pressure of exhaust gases in the exhaust manifold 14 is less than the pressure of air in the intake manifold 12. Thus, the EGR valve 20 enables exhaust gases to be advanced from the exhaust manifold 14 to the intake manifold 12 when the pressure of exhaust gases in the exhaust manifold 14 is greater than the pressure of air in the intake manifold 12. Moreover, the EGR valve assembly 20 prevents air in the intake manifold 12 from advancing to the exhaust manifold 14 when the pressure of air in the intake manifold 12 is greater than the pressure of exhaust gases in the exhaust manifold 14.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

What is claimed is:

1. An engine assembly, comprising:

an internal combustion engine having an engine air inlet and an engine exhaust outlet;

a valve assembly which includes a valve housing having a housing inlet and a housing outlet, said valve assembly is positionable between a first valve position and a second valve position;

a first conduit which connects said engine exhaust outlet in fluid communication with said housing inlet;

a second conduit which connects said engine air inlet in fluid communication with said housing outlet;

a camshaft having a cam member secured thereto, wherein (i) said cam member is positionable between a first cam member position and a second cam member position, (ii) said cam member causes said valve assembly to be positioned at said first valve position when said cam member is positioned at said first cam member position, and (iii) said cam member causes said valve assembly to be positioned at said second valve position when said cam member is positioned at said second cam member position; and a turbocharger in fluid communication with said first conduit and said engine air inlet, wherein (i) engine exhaust gases are allowed to advanced from said engine exhaust outlet to said engine air inlet when said valve assembly is positioned in said first valve position, and (ii) air is prevented from advancing from said engine air inlet to said engine exhaust outlet when said valve assembly is positioned in said second valve position.

2. The engine assembly of claim 1, wherein:

said valve assembly includes a valve member which is positioned in a flow path of engine exhaust gases, and movement of said cam member between said first cam member position and said second cam member position causes movement of said valve member between a flow blocking position and a flow enabling position.

3. The engine assembly of claim 2, wherein rotation of said camshaft causes said cam member to be moved between said first cam member position and said second cam member position.

4. The engine assembly of claim 1, wherein:

said second conduit is placed in fluid communication with said first conduit when said valve assembly is placed in the first valve position, and said second conduit is isolated from fluid communication with said first conduit when said valve assembly is placed in the second valve position.

5. The assembly of claim 2, wherein:

said cam member includes a plurality of lobes, and rotation of said camshaft causes each of said plurality of lobes to respectively move said valve member into the first valve position.

6. A method of controlling a flow of engine exhaust in an engine assembly which includes (i) an internal combustion engine having an engine air inlet and an engine exhaust outlet, (ii) a valve assembly which includes a valve housing having a housing inlet and a housing outlet, the valve assembly is movable between a first valve position and a second valve position, (iii) a first conduit which connects the engine exhaust outlet in fluid communication with the housing inlet, (iv) a second conduit which connects the engine air inlet in fluid communication with the housing outlet, and (v) a turbocharger in fluid communication with the first conduit and the engine air inlet, wherein the valve assembly (i) places the first conduit in fluid communication with the second conduit when the valve assembly is placed in the first valve position, and (ii) isolates the first conduit from the second conduit when the valve assembly is placed in the second valve position, comprising the steps of:

operating the engine assembly so as to cause sequential and repetitive time periods of pressure differential between the engine air inlet and the engine exhaust outlet, wherein each of the periods include (i) a first subperiod in which pressure at the engine air inlet is greater than or equal to pressure at the engine exhaust outlet, and (ii) a second subperiod in which pressure at the engine exhaust outlet is greater than or equal to pressure at the engine air inlet, wherein the periods recur at a predetermined frequency which is based on speed of the engine assembly; and operating the valve assembly based on the predetermined frequency.

7. The method of claim 6, wherein the valve assembly operating step includes the steps of:

moving the valve assembly from the first valve position to the second valve position; and returning the valve assembly from the second valve position to first valve position.

8. The method of claim 7, wherein the moving step and the returning step are both performed once during each of the time periods.

9. The method of claim 6, wherein the valve assembly operating step includes the steps of:

positioning the valve assembly in the first position during the second subperiod; and positioning the valve assembly in the second position during the first subperiod.

10. The method of claim 9, wherein both of the positioning steps are each performed once during each of the time periods.

11. The method of claim 9, wherein:

the step of positioning the valve assembly in the first valve position during the second subperiod allows exhaust gases to be advanced from the engine exhaust outlet to the engine air inlet, and the step of positioning the valve assembly in the second valve position during the first subperiod prevents exhaust gases from advancing from the engine exhaust outlet to the engine air inlet.

12. The method of claim 6, wherein:

the predetermined frequency increases when the engine assembly speed increases, and the predetermined frequency decreases when the engine speed assembly decreases.

13. The method of claim 6, wherein the speed of the engine assembly is defined as twice the speed of a camshaft of the engine assembly.

14. The method of claim 6, wherein:

the engine assembly further includes a camshaft having a cam member secured thereto, the valve assembly further includes a valve member which is positioned in a flow path of engine exhaust gases, the engine assembly operating step includes the step of rotating the camshaft at one half of the engine speed so as to move the cam member from a first cam member position to a second cam member position, the valve assembly operating step includes the step of moving the valve member between a flow blocking position and a flow enabling position, and the valve member moving step occurs in response to the camshaft rotating step.

15. The method of claim 14, wherein moving the cam member from the first cam member position to the second cam member position causes the valve member to be moved from the flow blocking position to the flow enabling position.

16. The method claim 14, wherein:

the cam member includes a plurality of lobes, and the camshaft rotating step includes the step of rotating the camshaft at one half of the engine speed so as to cause each of the plurality of lobes to respectively move the valve member into the first valve position thereby causing the valve assembly to be operated at the predetermined frequency.

* * * * *